United States Patent [19]

Lau et al.

[11] Patent Number: 4,494,388

[45] Date of Patent: Jan. 22, 1985

[54] KNIT CONSTRUCTION

[75] Inventors: Wing-Yan T. Lau; Laylon E. Bradberry, both of Seneca, S.C.

[73] Assignee: The Kendall Company, Walpole, Mass.

[21] Appl. No.: 421,110

[22] Filed: Sep. 22, 1982

[51] Int. Cl.[3] ..... A41B 00/00; D04B 11/00

[52] U.S. Cl. ..... 66/178 A; 66/169 A; 66/172 E

[58] Field of Search ..... 66/178, 178 A, 169 A, 66/169, 202, 172 E

[56] References Cited

U.S. PATENT DOCUMENTS

| | | | |
|---|---|---|---|
| 2,005,093 | 6/1935 | Lieberknecht | 66/169 A |
| 2,609,677 | 9/1952 | Picard | 66/169 A |
| 3,392,552 | 7/1968 | Muller et al. | 66/178 A |

*Primary Examiner*—Ronald Feldbaum

[57] ABSTRACT

A knit construction having a repeating six-course, two wale pattern in which the six courses include four courses comprising alternating knit and tuck stitches and two courses comprising alternating knit and float stitches, and each of the wales includes the knit stitches of two of the courses of alternating knit and tuck stitches and one of the courses of knit and float stitches, the tuck stitches of the other two of the courses of knit and tuck stitches, and the float stitches of the other of the courses of knit and float stitches.

15 Claims, 4 Drawing Figures

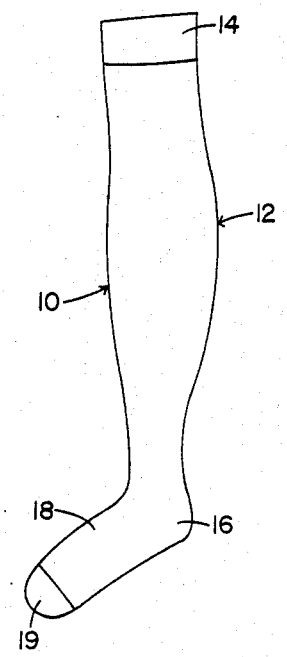
FIG 1
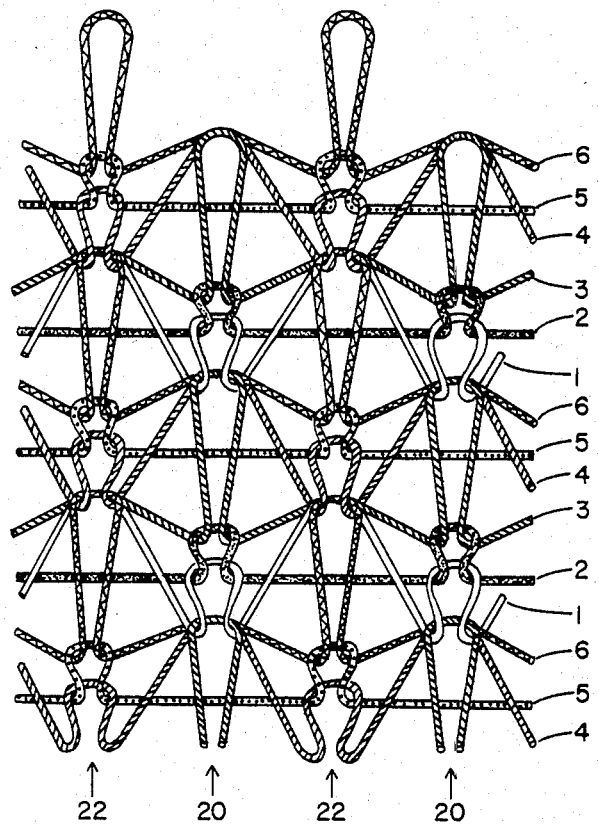
FIG 2
FIG 3
| COURSES | WALES 22 | 20 | 22 | 20 |
|---|---|---|---|---|
| 6 | X | O | X | O |
| 5 | X | - | X | - |
| 4 | X | O | X | O |
| 3 | O | X | O | X |
| 2 | - | X | - | X |
| 1 | O | X | O | X |
STITCHES { KNIT X, TUCK O, FLOAT - }
COURSES { 1, 2, 3, 4, 5, 6 }
FIG 4

KNIT CONSTRUCTION

This invention relates to knitting and, more particularly, to a new knit construction having improved characteristics for use in high-compression therapeutic stockings and the like.

It is a principal object of the present invention to provide a new knit construction that provides high compression with a minimum use of elastomer, permits large differences between stretched and relaxed stocking diameter, has improved stretch and recovery characteristics, provides a more constant pressure profile over a wide range of girth, and in which can be made to provide any of a wide range of desired pressure profiles. Other objects include providing such constructions which permit use of inexpensive bare elastomeric yarn rather than covered elastomers, permit large changes in pressure profile from point to point in a stocking, and is less susceptible to curl than conventional inlay, knit-float and all-knit constructions.

The invention features a knit construction having a repeating six-course, two-wale pattern in which the six courses include four courses comprising alternating knit and tuck stitches and two courses comprising alternating knit and non-knit stitches. Each of the wales includes the knit stitches of two of the courses of alternating knit and tuck stitches and one of the courses of knit and non-knit stitches, the tuck stitches of the other two courses of knit and tuck stitches, and the non-knit stitches of the other courses of knit and non-knit stitches.

In preferred embodiments the knit construction is used in a therapeutic stocking, the non-knit stitches are float stitches, a knit stitch and a tuck stitch in each wale pass over a float stitch in the same wale, and the courses of knit and float stitches are of bare elastomeric yarn.

Other objects, features and advantages will appear from the following detailed description of a preferred embodiment of the invention, taken together with the attached drawings in which:

FIG. 1 is a plan view of a compression stocking including the knit construction of the present invention;

FIG. 2 is a diagrammatic respresentation of the front of fabric comprising the knit construction of the present invention, showing the stitches;

FIG. 3 is a schematic representation of the knit construction of the present invention; and, FIG. 4 is a legend showing coding and symbols used in FIGS. 2 and 3.

Turning now to the drawings, FIG. 1 illustrates a therapeutic anti-embolism stocking, generally designated 10, comprising a leg portion 12 having a welt portion 14 at the upper end thereof, a heel portion 16, a foot portion 18, and a toe portion 19. The entire stocking, except for the welt portion 14 and the toe portion 19, are of fabric knit according to the present invention. The welt and toe are conventional jersey knit.

The fabric of the present invention is a knit construction comprising a repeating six-course, two-wale pattern. As shown in FIGS. 2 and 3, the six courses (designated 1 through 6 respectively) repeat through the height of the stocking; the two wales (designated 20 and 22 respectively) repeat around the stocking circumference.

Courses 1, 3, 4 and 6 are a textured nylon yarn such as that sold by E. I. duPont; courses 2 and 5 are a bare elastomeric yarn, such as DuPont Lycra. Each course 1 comprises, from right to left as shown, alternating knit and tuck stitches. Courses 2 comprise alternating knit and float stitches; and courses 3 comprise alternating knit and tuck stitches. The knit stitches of courses 1, 2 and 3 lie in wales 20, i.e., are vertically aligned with each other in every other wale.

Each course 4 comprises, again from right to left as shown, alternating tuck and knit stitches, as does each course 6. Each course 5 comprises alternating float and knit stitches. The knit stitches of courses 4, 5 and 6 lie in wales 22, intermediate the wales 20 containing the knit stitches of courses 1, 2 and 3.

As previously stated, the first and third stitches of courses 1, 2 and 3 are all knit stitches and lie in wales 20. The first and third stitches of courses 1 loop the first and third stitches of courses 2; the first and third stitches of courses 2 loop the first and third stitches of courses 3; and the first and third stitches of courses 3 pass over the first and third stitches of course 5 (which are float stitches) and, with the first and third stitches of courses 4 and 6 (both of which are tuck stitches), loop the first and third stitches of the next repeat of course 1.

In wales 22, the second and fourth stitches of courses 1 pass over the second and fourth stitches (the float stitches) of courses 2; and the second and fourth stitches of both of courses 1 and 3 are tucked behind the loops formed by the second and fourth stitches (the knit stitches) of courses 4.

It will be seen that the pattern of courses 4–6 essentially repeats that of courses 1–3, except that it is offset one wale so that the wales 22 containing the knit stitches of courses 4–6 lie between wales 20 of the knit stitches of courses 1–3.

Thus, in wales 22, the second and fourth stitches of courses 4 (which are knit stitches) loop the second and fourth stitches of courses 5; and the second and fourth stitches of courses 5 loop the second and fourth stitches of courses 6. Further, the second and fourth stitches of courses 6 pass over the float stitches (the second and fourth stitches) of course 2 and, with the second and fourth stitches (both tuck stitches) of courses 1 and 3 of the next repeat, loop the second and fourth stitches of the next repeat of course 4.

In wales 20, the first and third stitches of courses 4 (both tuck stitches) pass over the first and third stitches (the float stitches) of courses 5, and the first and third stitches of both of courses 4 and 6 are tucked behind the loop formed by the first and third stitches (the knit stitches) of courses 1.

In wales 20, it will be seen that the knit stitches of courses 3 and the tuck stitches of courses 4, i.e, the stitches that pass over the float stitches of courses 5 of elastomeric yarn, have relatively long, free "legs" extending generally along the wales, as do the knit stitches of courses 6 and the tuck stitches of courses 1 (i.e., the stitches that pass over the float stitches of courses 2) in wales 22. This construction permits the fabric to stretch in a horizontal or circumferential direction (parallel to the courses 2, 5 of elastomeric yarn). Stretch in the vertical direction is provided largely by the tuck stitches, which as shown in FIG. 2 extend diagonally of the fabric when the fabric is relaxed.

When the fabric is in its relaxed condition, the number of courses and wales per inch at various regions of the stocking, and the circumference of one size stocking, typically are generally as shown in the following table.

TABLE

| Region | Circumference | Courses/Inch | Wales/Inch |
|---|---|---|---|
| Ankle | 4 ¾ in. | 40–50 | 80–100 |
| Calf | 8 in. | 30–40 | 50–60 |
| Thigh | 11 in. | 25–30 | 35–45 |

When worn, the stocking typically will stretch lengthwise (i.e., along the wales) some 20%–30% in the ankle region, about 50% in the calf region, and 100% or more in the thigh region. The difference in relative stretch is a primary factor contributing to the large variance in the pressure profile of the stocking, there being less pressure in areas of greater lengthwise stretch.

The fabric of the present invention may be knit using any of a number of knitting machines having a wide range capability. Such machines include the Zodiac 4G manufactured by Billi S.p.A Firenze Cinstruzione Macchine Tessili of Italy, the Lonati 303 manufactured by Lonati Macchine Circolaci Per Calcifici of Italy, and the Nagata KT-Super 24 manufactured by Nagata Seiki Co., Ltd. of Japan. Such wide-range machines may be ordered new to produce a specified fabric, or existing machines may readily be modified or adapted as required. In general, the modifications required involve needle selection and placement, and cutting the jacks in the correct order.

Two exemplary high compression stockings made according to the present invention are as follows:

EXAMPLE 1

Using a 40 denier textured nylon on the four feeds used for courses 1, 3 4 and 6 and a 240 denier DuPont Lycra elastomeric yarn on the feeds for courses 2 and 5, a high compression panty hose with a pressure profile including 30 mm Hg at the ankle, 15 mm Hg at the calf and 10 mm Hg at the thigh was made.

EXAMPLE 2

Using a 70 denier texture nylon on the feeds in courses 1, 3, 4 and 6 and a 420 denier DuPont Lycra yarn on the feeds for courses 2 and 5, an extra high compression below knee stocking with a pressure profile of 50 mm Hg at the ankle and 20 mm Hg at the calf was made.

In other embodiments, the two courses of elastomeric yarn may be knit-tuck rather than knit-float, in which case the fabric will be double rather than single face; courses 1, 3, 4 and 6 may be any of a wide range of desired yarns, including textured filament, flat filament or spun yarn; and courses 2 and 5 may be any desired elastomeric yarn, either bare or covered. Stocking in which the fabric is used may be panty-style rather than thigh length; or the fabric may be used in any device other than a stocking in which the special characteristics of the fabric are desirable.

These and other embodiments will be within the scope of the following claims.

What is claimed is:

1. A knit construction having a repeating six-course, two wale pattern in which said six courses include four courses comprising alternating knit and tuck stitches and two courses comprising alterntaing knit and non-knit stitches, each of said wales includes the knit stitches of two of said courses of alternating knit and tuck stitches and one of said courses of knit and non-knit stitches, the tuck stitches of the other two of said courses of knit and tuck stitches, and the non-knit stitches of the other of said courses of knit and non-knit stitches, the non-knit stitches of the other of said courses being intermediate the tuck stitches of the other two of said courses, and said courses comprising alternating knit and non-knit stitches are of elastomeric yarn.

2. The knit construction of claim 1 wherein said elastomeric yarn is an uncovered elastomeric yarn.

3. The knit construction of claim 1 wherein said courses comprising alternate knit and tuck stitches are of textured nylon yarn.

4. The knit construction of claim 1 wherein each of said wales includes a knit stitch of one of said courses and a tuck stitch of another of said courses passing over a non-knit stitch of one of said courses.

5. The knit construction of claim 1 wherein said non-knit stitch is a float stitch.

6. A knit construction having a repeating six-course, two wale pattern and comprising:

a first course comprising alternating knit and tuck stitches, a second course comprising alternating knit and non-knit stitches, a third course comprising alternating knit and tuck stitches, a fourth course comprising alternating tuck and knit stitches, a fifth course comprising alternating non-knit and knit stitches, and a sixth course comprising alternating tuck and knit stitches, said second and fifth courses comprising elastomeric yarns, said knit stitches of said first, second and third courses being in one of said wales, and said knit stitches of said fourth, fifth and sixth courses being in the other of said wales.

7. The knit construction of claim 6 wherein said knit stitches of said first, second and third courses are in the same wales and the knit stitches of said fourth, fifth and sixth courses are in wales intermediate the wales including said knit stitches of said first, second and third courses.

8. The knit construction of claim 6 wherein said knit stitches of said first course loop said knit stitches of said second course, said knit stitches of said second course loop said knit stitches of said third course, and said knit stitches of said third course and the tuck stitches of said fourth and sixth courses loop the knit stitches of the next repeat of said first course.

9. The knit construction of claim 8 wherein said knit stitches of said fourth course loop said knit stitches of said fifth course, said knit stitches of said fifth course loop said knit stitches of said sixth course, and said knit stitches of said sixth course and said tuck stitches of the next repeat of said first and third courses loop the knit stitches of the next repeat of said fourth course.

10. The knit construction of claim 6 wherein said non-knit stitch is a float stitch.

11. The knit construction of claim 10 wherein the knit stitches of one of said first and third courses pass over the float stitches of one of a said second and fifth courses, and the knit stitches of one of said fourth and sixth courses pass over the float stitches of the other of a said second and fifth courses.

12. The knit construction of claim 11 wherein the knit stitches of said third course pass over the float stitches of said fifth course and the knit stitches of said sixth course pass over the float stitches of the next repeat of said second course.

13. A knit construction having a repeating six-course, two-wale pattern in which a first course comprises alternating knit and tuck stitches, a second course comprises alternating knit and float stitches, a third course comprises alternating knit and tuck stitches, a fourth course comprises alternating tuck and knit stitches, a fifth course comprises alternating float and knit stitches, a sixth course comprises alternating tuck and knit stitches, said second and fifth courses are of elastomeric yarn, said knit stitches of said first, second and third courses are in one of said wales, said knit stitches of said fourth, fifth, and sixth stitches are in the other of said wales, said knit stitches of said first course loop said knit stitches of said second course, the knit stitches of said second course loop said knit stitches of said third course, said knit stitches of said third course and said tuck stitches of said fourth courses pass over the float stitches of said fifth course said knit stitches of said fourth course loop said knit stitches of said fifth course, said knit stitches of said fifth course loop said knit stitches of said sixth course, and said knit stitches of said sixth course and said tuck stitches of a said first course pass over the float stitches of a said second course.

14. The knit construction of claim 13 in which said knit stitches of said third courses and said tuck stitches of said fourth and sixth courses loop the knit stitches of the next repeats of said first course.

15. The knit construction of claim 14 in which said knit stitches of said sixth courses and said tuck stitches of the next repeats of said first and third courses loop the knit stitches of the next repeats of said fourth course.

* * * * *